US009309750B2

(12) United States Patent
Coonrod

(10) Patent No.: US 9,309,750 B2
(45) Date of Patent: Apr. 12, 2016

(54) SUBSEA ON-SITE CHEMICAL INJECTION MANAGEMENT SYSTEM

(71) Applicant: Cameron International Corporation, Houston, TX (US)

(72) Inventor: Donald Scott Coonrod, Katy, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/316,534

(22) Filed: Jun. 26, 2014

(65) Prior Publication Data

US 2015/0376989 A1 Dec. 31, 2015

(51) Int. Cl.

| | |
|---|---|
| ***E21B 33/076*** | (2006.01) |
| ***E21B 43/01*** | (2006.01) |
| ***E21B 37/06*** | (2006.01) |
| ***E21B 33/068*** | (2006.01) |

(52) U.S. Cl.

CPC ..... *E21B 43/01* (2013.01); *E21B 33/068* (2013.01); *E21B 33/076* (2013.01); *E21B 37/06* (2013.01)

(58) Field of Classification Search

CPC ..... E21B 33/068; E21B 33/076; E21B 37/06; E21B 41/0007; E21B 43/01; E21B 43/16; E21B 43/25

USPC ..... 166/350, 368, 268, 263

See application file for complete search history.

(56) References Cited

U.S. PATENT DOCUMENTS

| | | | | |
|---|---|---|---|---|
| 4,214,628 | A * | 7/1980 | Botts | E21B 33/068 166/90.1 |
| 6,776,188 | B1 * | 8/2004 | Rajewski | B01F 5/0471 137/624.13 |
| 6,840,088 | B2 * | 1/2005 | Tucker et al. | 73/49.5 |
| 7,234,524 | B2 * | 6/2007 | Shaw et al. | 166/304 |
| 7,243,726 | B2 * | 7/2007 | Ohmer | 166/304 |
| 7,343,974 | B2 * | 3/2008 | Cowan | 166/295 |
| 7,841,394 | B2 * | 11/2010 | McNeel et al. | 166/90.1 |
| 7,931,082 | B2 * | 4/2011 | Surjaatmadja | 166/268 |
| 8,813,854 | B2 * | 8/2014 | Sahni et al. | 166/366 |
| 2005/0166961 | A1 | 8/2005 | Means et al. | |
| 2011/0220354 | A1 * | 9/2011 | Eikaas | B01F 3/1271 166/275 |
| 2013/0037140 | A1 * | 2/2013 | Krohn | B65D 88/30 137/561 A |
| 2013/0264064 | A1 * | 10/2013 | Lunde | C02F 1/686 166/347 |
| 2014/0000884 | A1 * | 1/2014 | Milam et al. | 166/268 |
| 2014/0208634 | A1 * | 7/2014 | Sferrazza | A01N 59/00 43/124 |
| 2014/0301790 | A1 * | 10/2014 | Chitwood | 405/210 |
| 2015/0167899 | A1 * | 6/2015 | August et al. | 137/1 |

FOREIGN PATENT DOCUMENTS

| | | | |
|---|---|---|---|
| WO | 0037770 | A1 | 6/2000 |
| WO | 2004016904 | A1 | 2/2004 |
| WO | 2010020956 | A2 | 2/2010 |

OTHER PUBLICATIONS

PCT International Search Report and Written Opinion for Application No. PCT/US2015/037738 mailed Oct. 12, 2015, 11 pages.

* cited by examiner

*Primary Examiner* — Matthew R Buck
(74) *Attorney, Agent, or Firm* — Fletcher Yoder, P.C.

(57) ABSTRACT

A system includes a subsea on-site chemical injection management system configured to inject a chemical mixture into a well, wherein the subsea on-site chemical injection management system includes a subsea on-site head tank configured to store a plurality of discrete chemicals, a subsea on-site mixing unit configured to mix one or more of the plurality of discrete chemicals to create one or more chemical mixtures, and a subsea on-site distribution unit configured to distribute the one or more chemical mixtures to the well.

20 Claims, 4 Drawing Sheets

SUBSEA ON-SITE CHEMICAL INJECTION MANAGEMENT SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are often used to access resources below the surface of the earth. For instance, oil, natural gas, and water are often extracted via a well. Some wells are used to inject materials below the surface of the earth, e.g., to sequester carbon dioxide, to store natural gas for later use, or to inject steam or other substances near an oil well to enhance recovery. Due to the value of these subsurface resources, wells are often drilled at great expense, and great care is typically taken to extend their useful life.

Chemical injection management systems are often used to maintain a well and/or enhance well output. For example, chemical injection management systems may inject chemicals to extend the life of a well or increase the rate at which resources are extracted from a well. Typically, these materials are injected into the well in a controlled manner over a period of time by the chemical injection management system.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
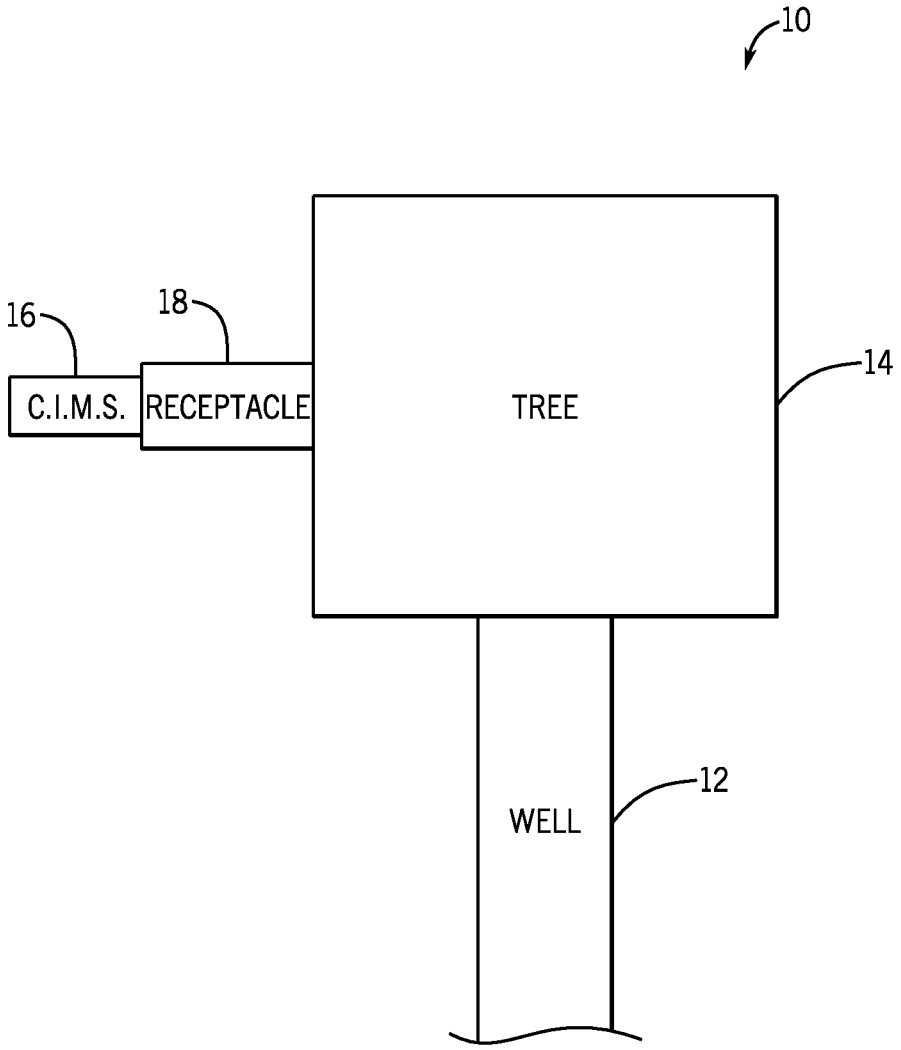
FIG. 1 is a block diagram of an embodiment of a resource extraction system, in accordance with aspects of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is generally directed toward a chemical injection management systems configured to supply chemicals and/or chemical mixtures into a well to extend the productive life of the well. Specifically, the disclosed embodiments include subsea on-site chemical injection management systems, which are physically located at or near a subsea wellhead. In other words, the disclosed embodiments include subsea on-site components configured to store, mix, measure, pump, and inject chemicals into a well to extend the useful life of the well and/or improve resource production of the well. As will be appreciated, injection of chemicals into a well may improve flow characteristics of production fluids within the well, inhibit or reduce blockages during normal and abnormal production operations, or otherwise improve production of minerals or resources from within the well.

Certain embodiments of the subsea on-site chemical management system include one or more components to store, mix, measure, pump, and inject chemicals or chemical mixtures into a well. For example, as described in detail below, the subsea chemical management system may include a subsea on-site head tank configured to store one or more chemicals (e.g., discrete and/or concentrated chemicals) in a subsea environment and/or on a sea floor. In certain embodiments, the head tank may be installed on a sea floor and may store multiple concentrated chemicals that may be mixed to produce a desired chemical mixture or "cocktail." In particular, the subsea on-site head tank may store the concentrated chemicals at an elevated position, and the potential energy (e.g., hydrostatic pressure) of the stored concentrated chemicals may be used to supply or "pump" the discrete, concentrated chemicals to a subsea on-site mixing unit of the subsea chemical management system. As described below, the subsea on-site mixing unit may be configured to receive the discrete, concentrated chemicals from the head tank and mix the concentrated chemicals according to mixing instructions or a "recipe" to generate a chemical mixture (e.g. cocktail) for injection into a well. The chemical mixture is supplied from the subsea on-site mixing unit to a subsea on-site distribution unit, where the chemical mixture is measured and pumped to one or more individual wells (e.g., wellheads). Once the well receives the chemical mixture, a local pump at the well may increase the pressure of the chemical mixture for injection into the well.

FIG. 1 depicts an exemplary resource extraction system 10 that may include a well 12, what is colloquially referred to as a "christmas tree" 14 (hereinafter, a "tree"), a subsea on-site chemical injection management system 16, and a valve receptacle 18. The illustrated resource extraction system 10 can be configured to extract hydrocarbons (e.g., oil and/or natural gas). The resource extraction system 10 is disposed subsea and may be configured to extract or inject other substances, such as those discussed above.

When assembled, the tree 14 may couple to the well 12 and include a variety of valves, fittings, and controls for operating the well 12. The chemical-injection management system 16 may be coupled to the tree 14 by the valve receptacle 18. The tree 14 places the chemical injection management system 16 in fluid communication with the well 12. The chemical injection management system 16 may inject chemicals and/or chemical mixtures into the well 12, such as corrosion-inhibiting materials, foam-inhibiting materials, wax-inhibiting materials, and/or antifreeze to extend the life of the well 12 or increase the resource extraction rate from the well 12. As explained below, the chemical-injection management system 16 may include multiple subsea on-site components configured to store, mix, meter, and pump one or more chemicals through the tree 14 and into the well 12.

Figure 2:
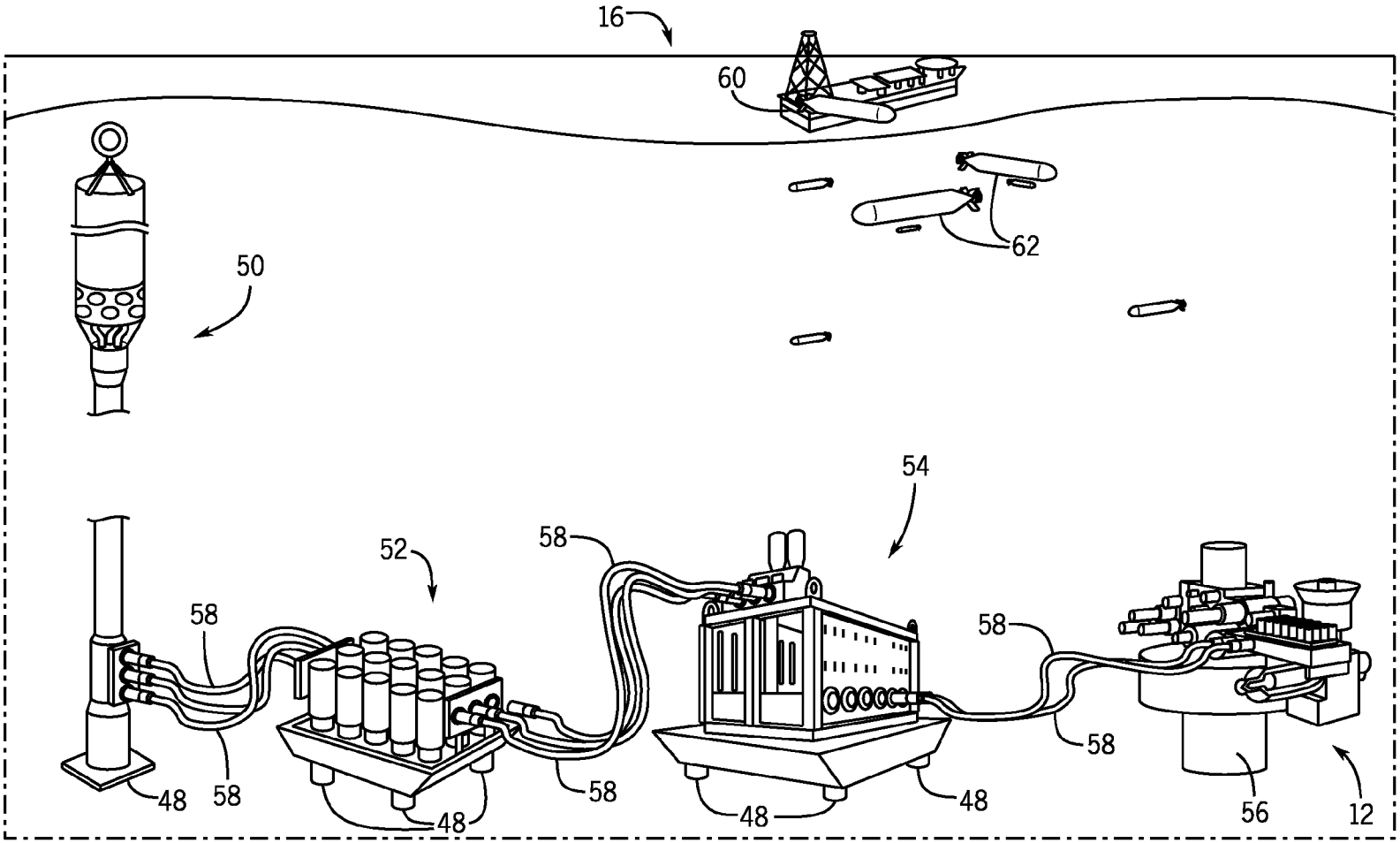
FIG. 2 is a schematic of an embodiment of a subsea chemical injection management system, in accordance with aspects of the present disclosure.

FIG. 2 is a schematic of an embodiment of the subsea on-site chemical injection management system 16 of FIG. 1, illustrating various subsea on-site components of the subsea on-site chemical injection management system 16. Specifically, the illustrated embodiment includes a subsea on-site head tank 50, a subsea on-site mixing unit 52, a subsea on-site distribution unit 54, and a wellhead 56 with a local pump (e.g., local pump 150 shown in FIG. 6). As shown, the subsea on-site components of the subsea on-site chemical injection management system 16 may be positioned on the sea floor. For example, one or more of the components may be mounted to the sea floor by one or more sea floor mounts 48, which may include foundations, mechanical couplings, and/or other components configured to mount the components to the sea floor. In other embodiments, one or more of the components may be supported by a platform or other structure extending from the sea floor. Each of the subsea components of the subsea chemical injection management system 16 will be discussed in further detail below.

The head tank 50 is configured to store one or more discrete chemicals (e.g., concentrated chemicals) that may be mixed and/or diluted with other chemicals or fluids to form a chemical mixture or "cocktail" for injection into the well 12. In particular, as discussed below, the head tank 50 has a tower configuration to enable elevated storage of the discrete chemicals. The potential energy of the elevated discrete chemicals is used as the driving force to flow or pump the chemicals to the mixing unit 52. In other words, the potential energy of the discrete chemicals stored at the top of the head tank 50 provides force to flow the chemicals out of the bottom of the head tank 50. When the chemicals exit the head tank 50, the chemicals flow to the mixing unit 52 through separate hoses 58 (e.g., pipes, conduits, etc.). That is, each hose 58 directs one of the discrete chemicals from the head tank 50 to the mixing unit 52.

In the mixing unit 52, the discrete chemicals received from the head tank 50 may be mixing according to a formula or "recipe" to create one or more chemical mixtures or "cocktails" for injection into the well 12. As discussed in detail below, the mixing unit 52 may include various containers, tanks, pumps, and so forth for receiving the discrete chemicals, mixing the discrete chemicals, and pumping the discrete chemicals from the mixing unit 52 to the distribution unit 54. The mixing unit 52 may also include a controller configured to regulate mixing of the discrete chemicals to create one or more chemical mixtures for injection into the well 12. For example, the controller may enable automated mixing of the discrete chemicals or enable a top side operator to regulate mixing of the discrete chemicals. Once the chemical mixture(s) are created, the chemicals mixture(s) may be pumped to the distribution unit 54 through hoses 58. That is, separate hoses 58 may flow separate chemical mixtures to the distribution unit 54.

The distribution unit 54 receives the chemical mixtures from the mixing unit 52 and measures the chemical mixtures for distribution to one or more wellheads 56 through individual hoses 58. As will be appreciated, it may be desirable to supply particular or measured amounts of the chemical mixtures to each of the wellheads 56. Additionally, the distribution unit 54 may be configured to enable pumping of multiple chemical mixtures to one wellhead 56. For example, the distribution unit 56 may enable pumping of a first chemical mixture to the wellhead 56 for a first time period and pumping of a second chemical mixture to the wellhead 56 for a second time period after the first time period. As shown, each chemical mixture may be supplied to the wellhead 56 through separate hoses 58.

Once the chemical mixture(s) arrive at the wellhead 56 through the hoses 58, a localized pump (e.g., subsea on-site pump 150 in FIG. 6) of the wellhead 56 may elevate the pressure of the chemical mixture(s) for injection into the well 12. As will be appreciated, it may be desirable to pump into the well 12 at elevated pressures. The localized pump of the wellhead 56 enables the chemical mixture(s) to be injected into the well 12 at elevated pressures, while also allowing the discrete chemicals and chemical mixture(s) to flow through the subsea chemical injection management system 16 upstream of the wellhead 56 at lower pressures. As will be appreciated, this configuration may reduce the power and/or energy (e.g., electrical energy) used by the subsea chemical injection management system 16.

As the discrete chemicals are stored subsea in the subsea head tank 50, the discrete chemicals in the head tank 50 may need to be replenished periodically. In certain embodiments, a top side processing unit 60 (e.g, a tanker, barge, derrick, or other floating vessel) may transfer discrete chemicals to one or more autonomous underwater vehicles (AUVs) 62 (e.g., submarine vehicles), which may then transfer the discrete chemicals to the head tank 50. The AUVs 62 and the head tank 50 reduce or eliminate the use of umbilicals (e.g., subsea, high pressure chemical supply hoses), which may otherwise be used to supply chemicals to a distribution unit 54 or wellhead 56 and are very costly. Additionally, the reduction of umbilical usage may reduce or eliminate other typical practices or operations associated with subsea umbilicals. For example, traditional umbilicals supply high pressure chemicals which are initially pressurized at the top side processing unit 60, which can be a very costly operation. As a result, the disclosed subsea chemical injection management system 16, which may not use traditional umbilicals, may cost less to operate than traditional chemical injection systems.

Figure 3:
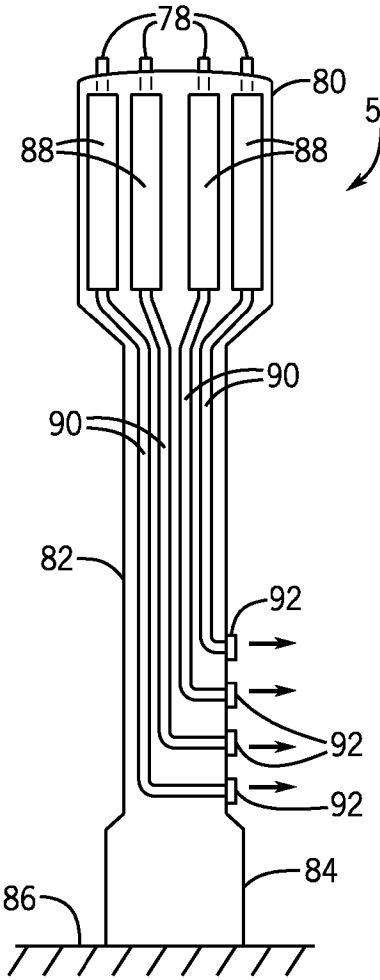
FIG. 3 is a schematic of an embodiment of a head tank of the subsea chemical injection management system of FIG. 2, in accordance with aspects of the present disclosure.

FIG. 3 is a schematic of an embodiment of the subsea on-site head tank 50 shown in FIG. 2. As mentioned above, the head tank 50 is a storage tank for storing discrete chemicals in a subsea environment, which may then be used (e.g., mixed) to create chemical mixtures for injection into the well 12. The illustrated embodiment of the head tank 50 includes an elevated reservoir 80, a column 82, and a base 84, which is positioned on a sea floor 86.

The elevated reservoir 80 contains several internal storage tanks 88, each of which may store a discrete chemical. For example, one of the internal storage tanks 88 may store methanol, methyl ethylene glycol (e.g., antifreeze), low-dose inhibitors, or other discrete chemicals. As mentioned above, the internal storage tanks 88 may be filled and/or re-filled with discrete chemicals by one or more autonomous underwater vehicles (AUVs) 62. In certain embodiments, the head tank 50 may include inlets or couplings 78 that enable the one or more AUVs 62 to connect to the head tank 50 and supply discrete chemicals to each of the internal storage tanks 88.

The elevated reservoir 80 may include 2, 3, 4, 5, 6, 7, 8, 9, 10, or more internal storage tanks 88, each configured to store one discrete chemical. In certain embodiments, the elevated reservoir 80 may be elevated 100, 200, 300, or more feet from the sea floor 86. As mentioned above, the elevated storage of the discrete chemicals enables the use of hydrostatic pressure of the discrete chemicals to drive (e.g., pump or flow) the discrete chemicals out of the head tank 50 and into the mixing unit 52. Specifically, each of the discrete chemicals may flow from one of the internal storage tanks 88 through a respective pipe 90 to a respective chemical outlet 92. As will be appreciated, the chemical outlets 92 and/or pipes 90 may also have various valves, fittings, actuators, or other piping components to enable flow control of the discrete chemicals.

Figure 4:
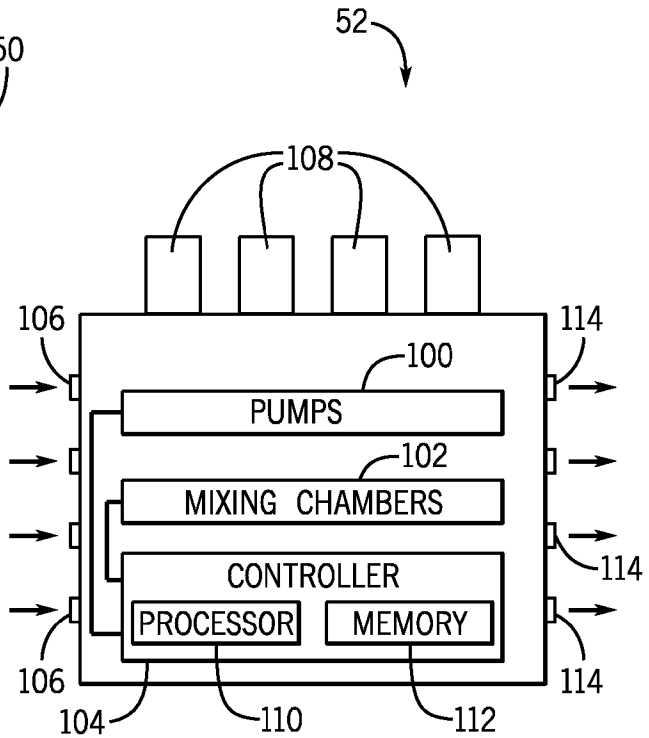
FIG. 4 is a schematic of an embodiment of a mixing unit of the subsea chemical injection management system of FIG. 2, in accordance with aspects of the present disclosure.

FIG. 4 is a schematic of an embodiment of the subsea on-site mixing unit 52 shown in FIG. 2. As mentioned above, the mixing unit 52 is configured to receive one or more discrete chemicals from the head tank 50 and subsequently mix one or more of the discrete chemicals according to a formula or recipe to create one or more chemical mixtures for injection into the well 12. To this end, the mixing unit 52 includes one or more pumps 100, one or more mixing chambers 102, and a controller 104 configured to regulate operation of the pumps 100 and mixing chambers 102. As will be appreciated, the mixing unit 52 may also include other various valves, actuators, fittings, batteries, and so forth, to enable flow and mixture of discrete chemicals and chemical mixtures within the mixing unit 52.

When the mixing unit 52 receives discrete chemicals from the head tank 50, the discrete chemicals may enter the mixing unit 52 through inlets 106. For example, each inlet 106 may receive one discrete chemical from one of the hoses 58 connecting one of the chemical outlets 92 of the head tank 50 to each inlet 106 of the mixing unit 52. In the illustrated embodiment, the mixing unit 52 includes tanks 108, which may be used to store the discrete chemicals prior to mixing. For example, each tank 108 may store one of the discrete chemicals separate from the other discrete chemicals received by the mixing unit 52.

The discrete chemicals are mixed within the mixing chambers 102 of the mixing unit 52. For example, each mixing chamber 102 may mix one chemical mixture using one or more of the discrete chemicals received by the mixing unit 52. As mentioned above, the controller 104 may regulate operation of the mixing chambers 102 and the pumps 100 of the mixing unit 52 to mix desired amounts of the discrete chemicals together to form a desired chemical mixture. In the illustrated embodiment, the controller 104 includes a processor (e.g., a microprocessor) 110 and a memory 112. The memory 112 is a non-transitory (not merely a signal), computer-readable media, which may include executable instructions that may be executed by the processor 110. For example, the memory 112 may be configured to store data pertaining to a formula or recipe for mixing a desired chemical mixture. Based on the formula or recipe, the controller 104 (e.g., the processor 110) may regulate operation of the pumps 100, the mixing chambers 102, and/or other components of the mixing unit 52, such as valves, actuators, and so forth, to mix a chemical mixture according to the formula or recipe stored in the memory 112. In certain embodiments, the controller 104 may also be configured to regulate operation of the mixing unit 52 based on input from a top side operator. For example, the controller 104 may be configured to communicate (e.g., wirelessly or through a wired connection) with the top side processing unit 60 shown in FIG. 2. In this manner, an operator may monitor and/or regulate operation of the subsea on-site chemical injection management system 16.

Once the chemical mixtures are created, the chemical mixtures may be supplied to the distribution unit 54 of the subsea chemical injection management system 16. Specifically, the chemical mixtures may flow out of the mixing unit 52 through outlets 114. That is, each unique chemical mixture may flow through one of the outlets 114 and into one of the hoses 58 connecting the mixing unit 52 to the distribution unit 54.

Figure 5:
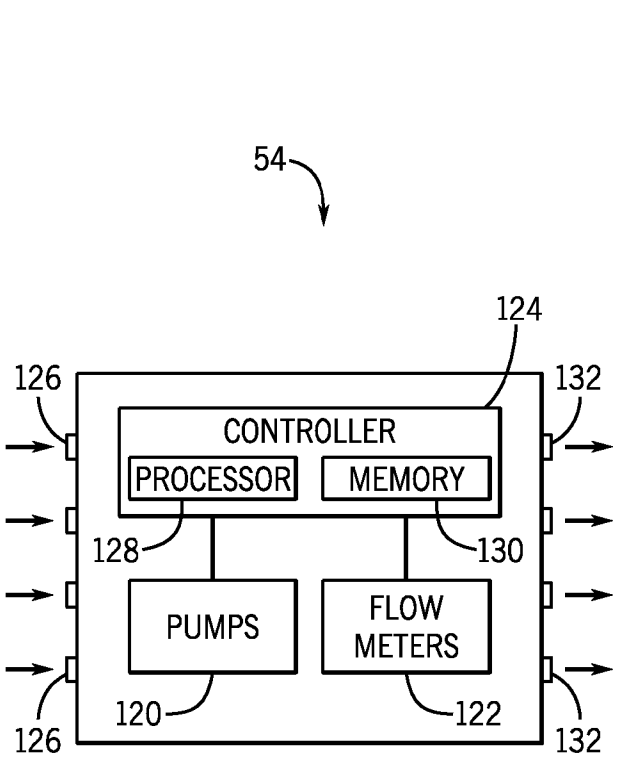
FIG. 5 is a schematic of an embodiment of a distribution unit of the subsea chemical injection management system of FIG. 2, in accordance with aspects of the present disclosure.

FIG. 5 is a schematic of an embodiment of the subsea on-site distribution unit 54 shown in FIG. 2. As mentioned above, the distribution unit 54 receives the chemical mixtures from the mixing unit 52 and measures the chemical mixtures for distribution to one or more wellheads 56. To this end, the distribution unit 54 includes one or more pumps 120 (e.g., which may be powered by on-site batteries), one or more flow meters 122, and a controller 124 configured to monitor and/or regulate the pumps 120 and flow meters 122.

The chemical mixtures created in the subsea mixing unit 52 enter the distribution unit 54 through the hoses 58 coupled to inlets 126 of the distribution unit 54. For example, each inlet 126 may receive a unique chemical mixture from the mixing unit 52. Within the distribution unit 54, the flow of the chemical mixture is regulated and measured by the pumps 120 and the flow meters 122, such that an appropriate or desired amount of the chemical mixture is supplied to one of the wellheads 56. In one embodiment, the flow of each chemical mixture received by the distribution unit 54 is regulated and monitored by a separate pump 120 and flow meter 122.

As mentioned above, the controller 124 is configured to monitor and/or regulate the pumps 120 and flow meters 122. In the illustrated embodiment, the controller 124 includes a processor 128 and a memory 130. The memory 130 is a non-transitory (not merely a signal), computer-readable media, which may include executable instructions that may be executed by the processor 128. For example, the memory 128 may be configured to store data associated with desired or target flow rates for certain chemical mixtures that are supplied to the wellhead 56.

The chemical mixtures exit the distribution unit 56 through outlets 132, which may be fluidly coupled to the wellhead 56 by the hoses 58 shown in FIG. 2. For example, each unique chemical mixture may flow through one of the outlets 12. As will be appreciated, the distribution unit 54 may supply multiple different chemical mixtures to the same wellhead 56 (e.g., through different hoses 58 connecting the distribution unit 54 to the wellhead 56). Additionally, the distribution unit 54 may be configured to supply one or more chemical mixtures to different wellheads 56. The distribution unit 54 may be configured to vary the flow of each chemical mixture based on the type of chemical mixture, the target wellhead 56, the well 12 formation, etc.

Figure 6:
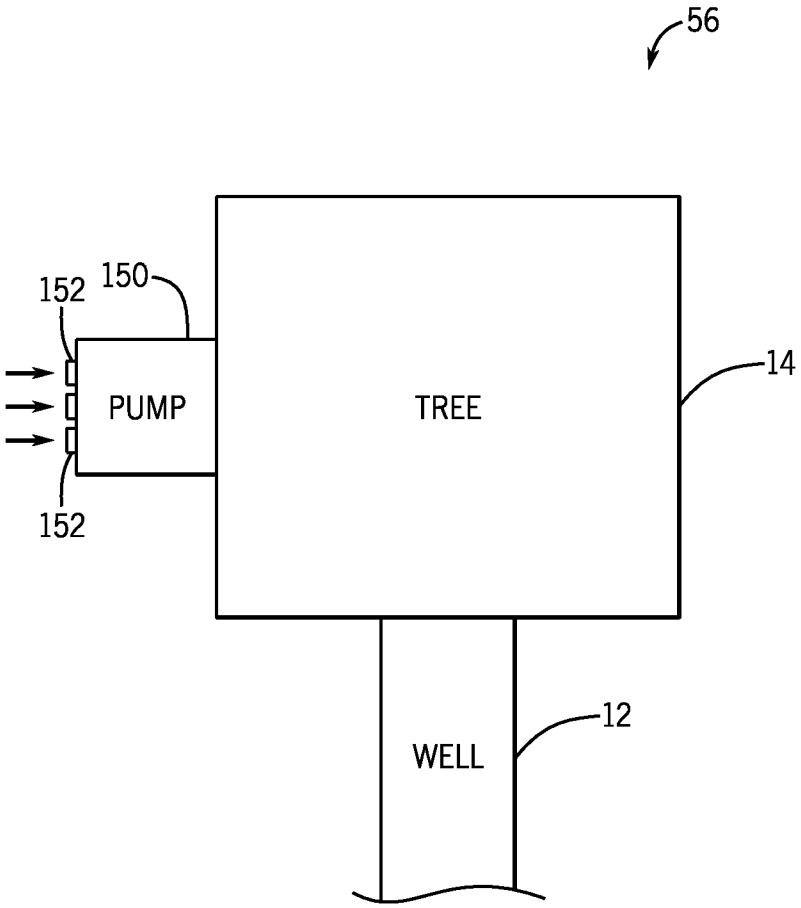
FIG. 6 is a schematic of an embodiment of a wellhead of the subsea chemical injection management system of FIG. 2, in accordance with aspects of the present disclosure.

FIG. 6 is a schematic of an embodiment of the wellhead 56 shown in FIG. 2. The wellhead 56 includes a localized pump 150 that is configured to increase the pressure of chemical mixtures received from the distribution unit 56 of the subsea chemical injection management system 16 prior to injection into the well 12.

In the illustrated embodiment, the localized pump 150 is coupled to the tree 14 of the wellhead 56 and includes multiple inlets 152. Each inlet 152 may receive a separate chemical mixture flow from the distribution unit 56, thereby enabling the injection of multiple chemical mixtures into the well 12. As the pump 150 increases the pressure of the chemical mixtures for injection at the location of the wellhead 56, the chemical mixtures may flow to the wellhead 56 (e.g., through the mixing unit 52, distribution unit 54, and hoses 58 upstream of the wellhead 56) at lower pressures, thereby reducing the energy and power used by the subsea chemical injection management system 16.

Figure 7:
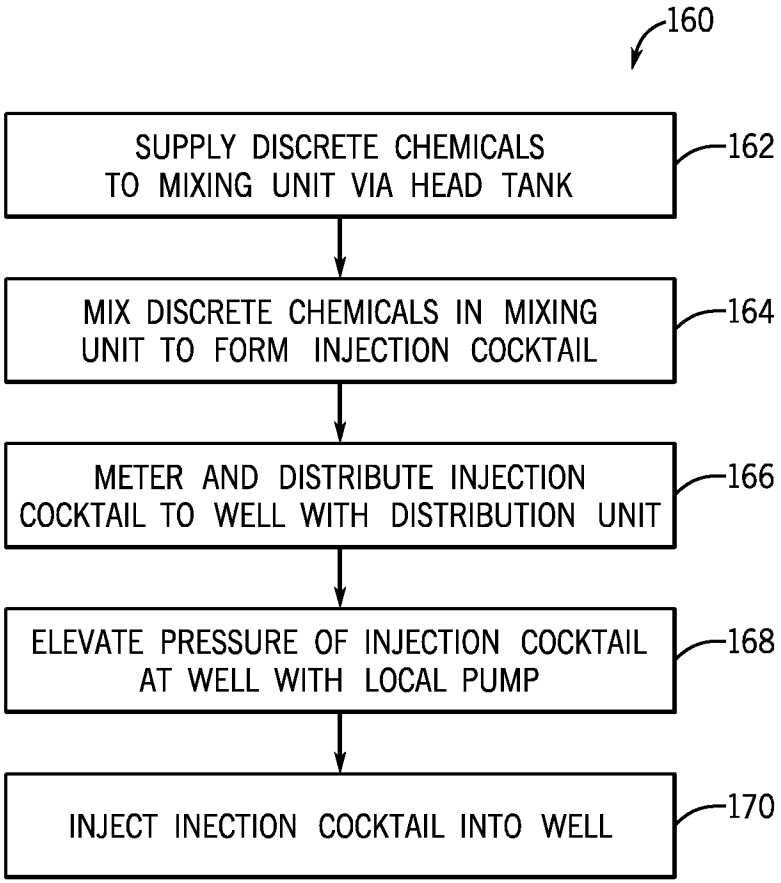
FIG. 7 is a method of injecting a chemical mixture into a well, in accordance with aspects of the present disclosure.

FIG. 7 is a flow chart of an embodiment of a method 160 of operating the subsea on-site chemical injection management system 16 described above. First, at step 162, discrete chemicals (e.g., concentrated chemicals) are supplied to the subsea on-site mixing unit 52 via the on-site head tank 50. As discussed in detail above, the discrete chemicals may be stored in the elevated reservoir 80 of the head tank 50, and the hydrostatic pressure (e.g., potential energy) of the discrete chemicals is used as a driving force to flow or pump the discrete chemicals from the head tank 50 to the mixing unit 52.

At step 164, one or more of the discrete chemicals are mixed in the mixing unit 52 to form a chemical mixture or chemical injection "cocktail." For example, one or more of the discrete chemicals may be mixed according to a formula or recipe stored in the memory 112 of the controller 104 of the mixing unit 52. Specifically, the controller 104 may regulate and/or monitor operation of pumps 100 and mixing chambers 102 of the mixing unit 52 to create the chemical mixtures from the discrete chemicals according to a formula or recipe.

After the chemical mixture is created in the mixing unit 52, the chemical mixture is metered and distributed with the on-site distribution unit 54, as indicated by step 166. For example, the distribution unit 54 may be configured to supply a desired amount of a chemical mixture to a particular wellhead 56 and another desired amount of a different chemical mixture to a different wellhead 56. After the chemical mixture is measured and distributed to the wellhead 56 by the distribution unit 54, the pressure of the chemical mixture may be elevated at the site of the wellhead 56 by a localized pump 150 at the wellhead 56, as indicated by step 168. As discussed in detail above, the localized pump 150 enables the elevation of chemical mixture pressure at the site of the wellhead 56 instead of upstream of the wellhead 56, such as at the top side processing unit 60. In this manner, the chemical mixture may be highly pressurized for a shorter distance before being injected into the well 12, thereby reducing energy consumption by the subsea chemical injection management system 16. After the chemical mixture is pressurized by the pump 150, the chemical mixture may be injected into the well 12, as indicated by step 170.

As discussed in detail above, the present disclosure is generally directed toward the subsea on-site chemical injection management system 16 configured to supply chemicals and/or chemical mixtures into the well 12 to extend the productive life of the well. In particular, the subsea on-site chemical injection management system 16 includes subsea on-site components configured to store, mix, measure, pump, and inject chemicals into the well 12 to extend the useful life of the well and/or improve resource production of the well. For example, as described in detail above, the subsea on-site chemical management system 16 may include the subsea head tank 50 configured to store one or more chemicals (e.g., discrete and/or concentrated chemicals) at the sea floor 56. The head tank 50 stores concentrated chemicals at an elevated position, and the potential energy of the stored concentrated chemicals is used to supply or "pump" the discrete, concentrated chemicals to the subsea mixing unit 52 of the subsea on-site chemical injection management system 16. As described above, the subsea on-site mixing unit 52 is configured to receive the discrete, concentrated chemicals from the on-site head tank 50 and mix the concentrated chemicals according to mixing instructions or a "recipe" to generate a chemical mixture (e.g. cocktail) for injection into the well 12. The chemical mixture is supplied from the subsea on-site mixing unit 52 to the subsea on-site distribution unit 54, where the chemical mixture is measured and pumped to one or more individual wells 12 (e.g., wellheads 56). Once the wellhead 56 receives the chemical mixture, the local pump 150 at the well increases the pressure of the chemical mixture for injection into the well 12. As a result, the chemicals and chemical mixtures upstream of the wellhead 56 may be flowed at lower pressures, thereby reducing energy consumption of the subsea chemical injection management system 16 and reducing costs associated with umbilicals and other equipment typically used to supply chemicals to the well 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a subsea on-site chemical injection management system configured to inject a chemical mixture into a well, wherein the subsea on-site chemical injection management system comprises:

a subsea on-site head tank configured to store a plurality of discrete chemicals, wherein the subsea on-site head tank comprises an elevated reservoir and a plurality of discrete chemical outlets at a base of the subsea on-site head tank;

a subsea on-site mixing unit configured to mix one or more of the plurality of discrete chemicals to create one or more chemical mixtures; and a subsea on-site distribution unit configured to distribute the one or more chemical mixtures to the well.

2. The system of claim 1, wherein the subsea on-site chemical injection management system comprises a local pump coupled to a wellhead of the well, wherein the local pump is configured to elevate a pressure of the one or more chemical mixtures prior to injection into the well.

3. The system of claim 1, wherein the elevated reservoir comprises a plurality of internal storage tanks, wherein each of the plurality of internal storage tanks is configured to store a respective one of the plurality of discrete chemicals.

4. The system of claim 1, wherein the subsea on-site head tank is configured to mount on a sea floor.

5. The system of claim 1, wherein the subsea on-site chemical injection management system comprises a plurality of fluid conduits extending from the base of the head tank to the subsea on-site mixing unit, wherein each of the plurality of fluid conduits is configured to flow a respective one of the plurality of discrete chemicals.

6. The system of claim 1, wherein the subsea on-site chemical injection management system comprises at least one fluid conduit extending from the subsea on-site mixing unit to the subsea on-site distribution unit, wherein each of the at least one fluid conduit is configured to flow a respective one of the one or more chemical mixtures.

7. The system of claim 1, wherein the subsea on-site mixing unit comprises a controller configured to regulate one or more components of the subsea on-site mixing unit, wherein the controller comprises a memory configured to store at least one formula of the one or more chemical mixtures.

8. The system of claim 7, wherein the controller is configured to communicate with a top side processing unit at a surface above the subsea on-site chemical injection management system.

9. The system of claim 1, comprising an autonomous underwater vehicle configured to transfer additional amounts of the plurality of discrete chemicals from a top side processing unit to the subsea on-site head tank.

10. A method, comprising:

flowing a plurality of discrete chemicals from an elevated reservoir of a subsea on-site head tank through a plurality of discrete chemical outlets formed in a base of the subsea on-site head tank to a subsea on-site mixing unit;

mixing one or more of the plurality of discrete chemicals within the subsea on-site mixing unit to create one or more chemical mixtures;

flowing the one or more chemical mixtures from the subsea on-site mixing unit to a subsea on-site distribution unit; and distributing the one or more chemical mixtures to a subsea well.

11. The method of claim 10, comprising storing each the plurality of discrete chemicals in individual internal storage tanks disposed in the elevated reservoir of the subsea on-site head tank.

12. The method of claim 11, wherein flowing the plurality of discrete chemicals from the subsea on-site head tank to the subsea on-site mixing unit comprises using hydrostatic pressure of the plurality of discrete chemicals in the individual internal storage tanks to flow the plurality of discrete chemicals from the subsea on-site head tank to the subsea on-site mixing unit.

13. The method of claim 11, comprising refilling the individual internal storage tanks of the subsea on-site head tank with the plurality of discrete chemicals using an autonomous underwater vehicle.

14. The method of claim 10, wherein mixing one or more of the plurality of discrete chemicals within the subsea on-site mixing unit to create one or more chemical mixtures comprising mixing one or more of the plurality of discrete chemicals according to a formula stored in a memory of the subsea on-site mixing unit.

15. The method of claim 10, comprising elevating a pressure of the one or more chemical mixtures with a local pump of the subsea well prior to injection into the subsea well.

16. The method of claim 10, wherein distributing the one or more chemical mixtures to the subsea well comprises regulating distribution of the one or more chemical mixtures with a controller of the subsea on-site distribution unit, wherein the controller is configured to communicate with a top side processing unit at a surface above the subsea on-site distribution unit.

17. A system, comprising:

a subsea on-site chemical injection management system configured to inject a chemical mixture into a well, wherein the subsea on-site chemical injection management system comprises:

a subsea on-site head tank comprising an elevated reservoir configured to store a plurality of discrete chemicals, a column supporting the elevated reservoir, and a plurality of discrete chemical outlets at a base of the column, wherein each of the plurality of discrete chemical outlets is configured to output a flow of a respective one of the plurality of discrete chemicals;

a subsea on-site mixing unit configured to mix one or more of the plurality of discrete chemicals to create one or more chemical mixtures; and a local pump coupled to a wellhead of the well, wherein the local pump is configured to elevate a pressure of the one or more chemical mixtures prior to injection into the well.

18. The system of claim 17, wherein the subsea on-site chemical injection management system comprises at least one subsea mount configured to mount the subsea on-site head tank, the subsea on-site mixing unit, or a combination thereof, to a sea floor.

19. The system of claim 17, wherein the subsea on-site chemical injection management system comprises a subsea on-site distribution unit upstream of the local pump, wherein the subsea on-site distribution unit is configured to meter and distribute the one or more chemical mixtures to the local pump.

20. The system of claim 17, wherein the subsea on-site head tank comprises:

a plurality of internal storage tanks disposed within the elevated reservoir, wherein each of the plurality of internal storage tanks is configured to store a respective one of the plurality of discrete chemicals; and a plurality of inlets, wherein each of the plurality of inlets is in fluid communication with a respective one of the plurality of internal storage tanks, and each of the plurality of inlets is configured to receive a flow of a respective one of the plurality of discrete chemicals from an autonomous underwater vehicle.

* * * * *